United States Patent [19]

Landoni

[11] 4,106,417

[45] Aug. 15, 1978

[54] APPARATUS FOR CONTROLLING THE MOVEMENT OF A FABRIC-SUPPORTING CARRIAGE IN A QUILTING MACHINE

[75] Inventor: Giannino Landoni, Fagnano Olona, Italy

[73] Assignee: MECA S.n.c., Cassano Magnago, Italy

[21] Appl. No.: 726,757

[22] Filed: Sep. 27, 1976

[30] Foreign Application Priority Data

Oct. 3, 1975 [IT] Italy ..... 27933 A/75

[51] Int. Cl.[2] ..... D05B 21/00; D05B 11/00

[52] U.S. Cl. ..... 112/119; 112/121.12

[58] Field of Search ..... 112/117–119, 112/121.12, 121.15, 102

[56] References Cited

U.S. PATENT DOCUMENTS

| | | | |
|---|---|---|---|
| 2,855,877 | 10/1958 | Whitehead | 112/121.12 X |
| 2,871,723 | 2/1959 | Shephard | 112/118 X |
| 3,691,857 | 9/1972 | Cooper | 112/118 X |

*Primary Examiner*—Peter Nerbun

*Attorney, Agent, or Firm*—Browdy and Neimark

[57] ABSTRACT

An apparatus for controlling the movement of a fabric-supporting carriage in a quilting machine includes a slider integral with the carriage. The slider is housed within a rotatable member and provided with an element slidably inserted in a shaped groove. The groove is formed in a perforated wall fixed in the frame below a guide in which the slider is positioned. The perforation in the wall is coaxial with a shaft which is fixed to a gear, the shaft being integral with the rotatable member.

7 Claims, 4 Drawing Figures

APPARATUS FOR CONTROLLING THE MOVEMENT OF A FABRIC-SUPPORTING CARRIAGE IN A QUILTING MACHINE

BACKGROUND OF THE INVENTION

This invention relates to an apparatus for controlling the movement of a fabric-supporting carriage in a quilting machine.

It is known that in quilting machines which are capable of performing stitching lines along non-rectilinear paths, the fabric-supporting carriage is caused to move transversally to the advancement direction of the material to be quilted. In these conventional quilting machines, such movement is obtained by providing the fabric-bearing carriage, at the side thereof, with cams or worm screws cooperating therewith, suitable to impart to the fabric-supporting carriage a reciprocating movement, the amplitude and speed of which depend on the shape of the stitching which one desires to obtain. The fabric-supporting carriage and consequently the article to be stitched are movable along a line in a plane at right angle to the movement of the needles which carry out the stitching.

A principal drawback presented by the conventional machines of the above-mentioned type is in the limitation of the possible shapes of the stitching which can be obtained because the non-rectilinear stitchings are obtained as a result of the composition of the relative movements of the material to be quilted, and the translation movement of the fabric-supporting carriage. Such movements are both rectilinear and at right angles to each other; therefore, it is apparent that the stitching pattern can only be varied by changing the relative speed of the two movements mentioned above.

There are also known quilting machines in which the fabric-supporting carriage moves both transversely to the advancement direction of the material to be quilted and along directions substantially parallel to the advancement direction. Thus the fabric-supporting carriage is endowed with a movement referred to in art as "floating" movement with respect to the needles. This movement of the carriage is obtained by using extremely complicated devices, such as for instance worm screws driven by step-by-step motors which are in turn programmed by computers or magnetic punched tapes. The cost of these conventional quilting machines is consequently very high.

SUMMARY OF THE INVENTION

It is the principal object of the present invention to provide an apparatus for controlling the movement of a fabric-bearing carriage in a quilting machine which is not subjected to the drawbacks and shortcomings of conventional machines mentioned above.

It is another object of the present invention to provide an apparatus for controlling the movement of a fabric-bearing carriage in a quilting machine which is simple and yet makes it possible to obtain rectilinear or curve stitchings of any form whatsoever, particularly stitches of closed shape.

It is an additional object of the present invention to provide an apparatus for controlling the movement of a fabric-bearing carriage of a quilting machine provided with a single needle-bearing bar, instead of a couple of needle-bearing bars as in the conventional quilting machines, and yet which produces rectilinear, curved and/or closed stitching.

The control apparatus of the present invention is characterized in that the fabric-supporting carriage is integral with a slider housed within a rotatable member and provided with an element slidably inserted in a shaped groove. The groove is formed in the frame of the quilting machine.

One of the principal advantages of the control apparatus according to the present invention resides in the fact that the fabric-supporting carriage is movable along a path which corresponds to the shape of the stitching to be obtained, so that the material placed on it moves progressively to the various positions required for the stitching below the needle-bearing bar. Indeed, not only the fabric-supporting carriage moves transversely to the advancement direction of the material to be quilted, but also along directions substantially parallel to said advancement direction, so that the sequence of the positions occupied by the carriage reproduces the stitching patterns which one desires to obtain.

A further advantage of the control apparatus of the present invention is that it is possible to modify, within a very short time span, both shapes and sizes of the stitching pattern.

BRIEF DESCRIPTION OF THE DRAWINGS

Further advantages and characteristics of the apparatus according to the present invention are to become apparent from the following description of a preferred embodiment, with reference to the accompanying drawing, wherein.

DETAILED DESCRIPTION OF THE PREFERRED EMBODIMENT

Figure 1:
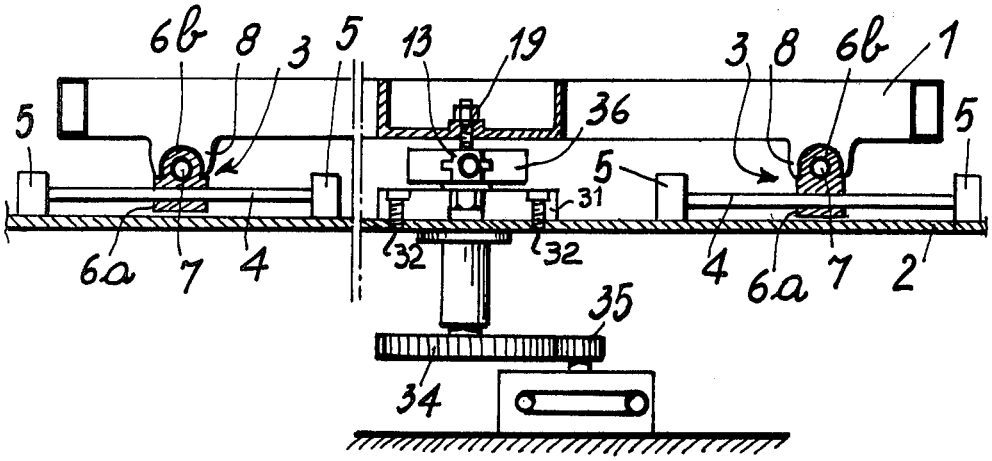
FIG. 1 is a rear vertical section of an exemplary embodiment of a control apparatus according to the present invention.
Figure 2:
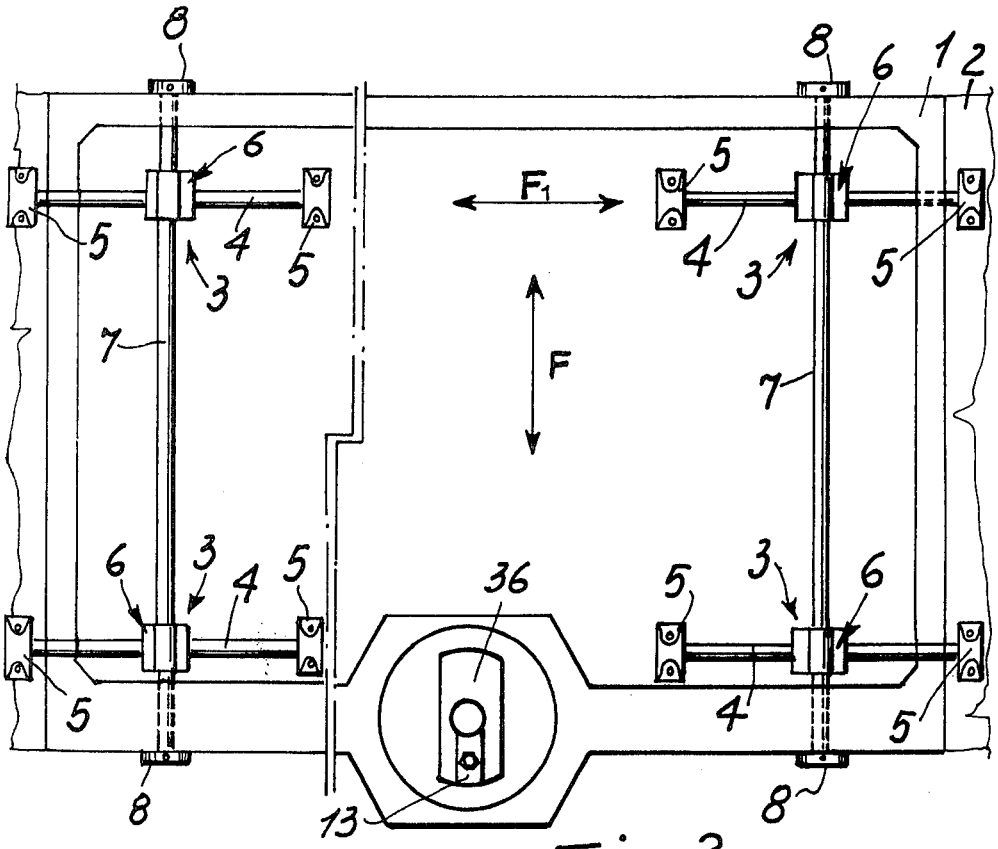
FIG. 2 is a plan view of the apparatus of FIG. 1.

With specific reference to FIGS. 1 and 2, there is represented a fabric-supporting carriage 1 of a quilting machine having a rectangular framework which is to bear rolls of the material to be quilted (not shown) and supported by a frame 2 of the quilting machine by slides 3 suitable for permitting the carriage to move both along a direction F, parallel to the advancement direction of the material to be quilted, and along a direction $F_1$ at right angles to the advancement. To this end, the slides 3 are formed by four bars 4 placed substantially at the vertices of the carriage 1, parallel to the direction $F_1$, fixed to the frame 2 of the quilting machine by ports 5. A respective first member 6*a* of each of sleeves 6 is slidable on the respective bars 4, which sleeves are provided with respective second members 6*b* slidable on respective bars 7 fixed at the end thereof to fins 8 of the fabric-supporting carriage 1. The assembly of the slides 3 is known per se and has been used conventionally in some quilting machines and is not a novel part of the present invention.

With reference to FIGS. 1 through 4, the fabric-supporting carriage 1 is integral with a slider 9, which is to be herebelow described, housed within a rotatable member 10 and provided with a portion 11 slidably inserted in a groove 12 defining a path having a shape corresponding to that of the stitching to be obtained.

The slider 9 includes a substantially parallelepiped body 13 two opposite faces of which are provided with straight projections 14 having a rectangular cross-section, which are suitable for permitting the slider 9 to slide in the rotatable member 10. The substantially parallelepiped body 13 presents a longitudinally extending groove 15 in which a block 16 having two holes 17, 18 at right angles to one another, is housed. A threaded pin 19 is screwed into the hole 17 so as to fasten the slider 9 to the fabric-supporting carriage 1. Such fastening is accomplished by a nut 20, a washer 21 and a friction sleeve 22 so as to prevent any relative movement between the fabric-supporting carriage 1 and the pin 19. A screw 23 is screwed within the hole 18 for adjusting the position of the block 16 and, consequently, adjustment of the fabric-supporting carriage 1 fixed to the pin 19.

To permit such displacements, the substantially parallelepiped body 13 is provided, on its face facing the fabric-supporting carriage 1, with a slot 24 the length of which delimits the extent of possible displacement of the pin 19. A head 25 of the screw 23 is rotatably blocked on a stop plate 26 fastened to the substantially parallelepiped body 13. To this end, there is provided a washer 27 keyed to the screw 23 suitable for engagement with the head 25 against the stop plate 26, even if rotations of screw 23 are permitted. The substantially parallelepiped body 13 presents, on its face opposite that face where the slot 24 is provided, a pin 28 on which there is placed an annular member 29 rotatable thereabout. The pin 28 and the annular member 29 are inserted in the groove 12 having a rectangular cross-section, provided in a plate 31 fastened by screws 32 to the frame 2 of the quilting machine.

Figures 3, 4:
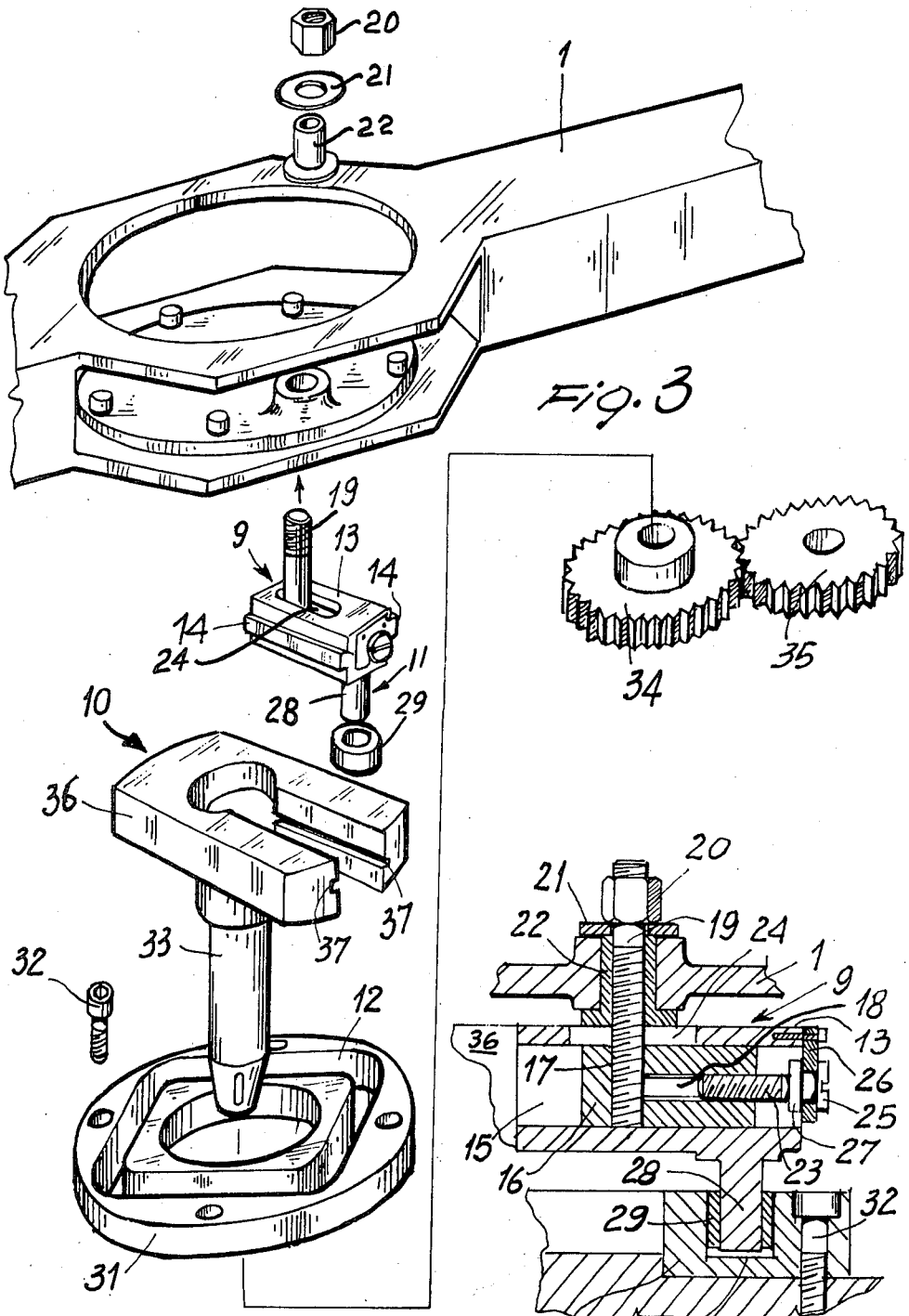
FIG. 3 is an exploded, perspective view of a portion of the apparatus of FIGS. 1 and 2 according to the present invention.
FIG. 4 is a side, enlarged, vertical view of a portion of the apparatus of FIG. 3.

As is particularly shown in FIG. 3, the groove 12 is rectangularly shaped with chamfered edges to facilitate sliding of the pin 28 and the annular member 29 therein and, as such, to permit a stitching to be obtained having a correspondingly rectangular shape, the dimensions of which depend on the mutual position of the pins 19 and 28. The position can be varied through the adjustment screw 23, by varying the position of the block 16 and consequently of the pin 19.

With particular reference to FIG. 3, the rotatable element 10 includes a substantially T-shaped body, a vertical branch 33 of which is constituted by a shaft rotatably driven by a pinion gear 34. This latter is actuated through a further pinion gear 35 by a motor (not shown) which controls the movement of the fabric-supporting carriage 1. As in conventional machines, such motor is suitable to impart to the rotatable member 10 intermittent rotation.

The upper portion of the rotatable member 10 is provided with a guide 36 having grooves 37 therein suitable for slidably receiving the straight projections 14 of the slider 9. The slider 9, during the rotations of the member 10, can therefore move within the guide 36 and its portion 11 runs along the grooves 12 on the plate 31.

The operation of the control device according to the present invention is set out below. Firstly, a particular plate 31 having the groove 12 shaped correspondingly to the stitching which one desires to obtain is selected. For instance, if a circular stitching has to be performed, a plate 31 having a circular groove is selected, whereas in the case of a polygon or a flower-shaped stitching, a plate 31 having a correspondingly shaped groove is selected. The size of the stitching essentially depends on the distance between the pin 19 and the pin 28, so that the operator, before actuating the quilting machine, provides for the adjustment of the distance between the two pins 19 and 28. In order to carry out such adjudgment, the operator unlocks the pin 19 unscrewing it from the hole 17 and provides for its displacement by rotating the screw 23 which controls the displacement of the block 16. Finally, the operator again screws the pin 19 into the hole 17, by fastening it in the preset position. The slider 9 is then inserted within the guide 36 of the rotatable member 10, and the pin 19 is fixed in the above-described manner to the fabric-supporting carriage 1. The operator can then actuate the quilting machine and the rotatable member 10 is caused to rotate intermittently, transmitting through the slider 9, such rotatory movement to fabric-supporting carriage 1. The slider 9, in case groove 12 is circular, rotates along with the member 10 transmitting a rotatory circular movement to fabric-supporting carriage 1 and in this way a circular stitching is obtained. The position of slider 9 within guide 36 is fixed because the distance between the rotation axis of the member 10 and the pin 28 does not vary. When a polygon-shaped stitching is desired, such distance is varied and is compensated for by displacement of the slider 9 within the guide 36. In this case, the fabric-supporting carriage 1 moves along a zig-zag closed path delimiting a polygon-shaped pattern corresponding to the shape of the groove 12. It is apparent that, also in case of a polygon-shaped stitching, the size of the stitching depends on the distance of the pin 19 to the pin 28, which distance is preliminarily adjusted by the operator in the above-described manner. The adjustment of the distance of the pin 19 to the pin 28 is essential because by virtue of it, it is possible to vary not only the size of the stitching obtained, but also its shape without substituting a different plate 31 thus modifying the type of groove used. Indeed, when the distance between the pins 19 and 28 is less than a value which varies from groove to groove, the shape of the obtained stitching is remarkably different from the shape of the groove. The operator can therefore obtain variously shaped stitchings by using a single groove. It is sufficient that the operator knows the relationship existing between the values of the distances of pin 19 to pin 28 on one side and the shape of the stitchings obtained on the other side. This can be easily made by reporting in a table such relationship and coupling an explanatory table to each control device to which an operator may refer.

Finally, it should be noted that the control device placed in the rear middle part of the quilting machine permits the elimination of the vibrations which are otherwise present in conventional machines in which the control device is placed laterally of the fabric-supporting carriage.

It is to be appreciated that numerous changes and modifications could be made to the illustrative embodiment of the control device according to the present invention, without departing from the spirit and scope thereof, its scope being defined in the appended claims.

What is claimed is:

1. In a quilting machine having a fabric-supporting carriage and a needle-supporting bar and means for guiding the movement of the carriage relative to the bar, which means includes a cam and follower arrangement wherein the cam is a substantially flat member having a groove and the follower includes a pin which engages into the groove, the improvement wherein said cam and follower arrangement comprises a rotatable member comprising a shaft and a shaped guide coupled to said shaft; a slider slidably housed in said guide wherein said slider protrudes from said guide and being mounted for sliding movement with respect to the guide during rotation of the shaft with a first pin connected to said fabric-supporting carriage and with a second pin parallel to said first pin slidably housed within said groove; and means for adjusting distance between said first and second pins.

2. In a quilting machine having a fabric-supporting carriage and a needle-supporting bar and means for guiding movement of the carriage relative to the bar, which means includes a cam and follower arrangement wherein the cam is a substantially flat member having a groove and the follower includes a pin which engages into the groove, the improvement wherein said cam and follower arrangement comprises a substantially T-shaped rotatable member having a shaft to be driven by a driving motor and having a substantially U-shaped guide coupled to said shaft; a slider slidably housed in said guide, said slider being mounted for sliding movement with respect to the U-shaped guide during rotation of the T-shaped member and protruding from said guide with a first pin for connection to said fabric-supporting carriage and with a second pin parallel to said first pin slidably housed within said groove; and means for adjusting distance between said first and second pins.

3. An improved quilting machine according to claim 2, wherein said U-shaped guide is integral with said shaft.

4. An improved quilting machine according to claim 2, wherein said groove is rectangularly shaped and has chamfered edges to facilitate sliding of said second pin therein.

5. In a quilting machine having a fabric-supporting carriage and a needle-supporting bar and means for guiding movement of the carriage relative to the bar, which means includes a cam and follower arrangement wherein the cam is a substantially flat member having a groove and the follower includes a pin which engages into the groove, the improvement wherein said cam and follower arrangement comprises a substantially T-shaped rotatable member having a shaft to be driven by a driving motor and having a substantially U-shaped guide coupled to said shaft; a slider slidably housed in said guide, said slider protruding from said guide with a first pin for connection to said fabric-supporting carriage and with a second pin parallel to said first pin slidably housed within said groove; and means for adjusting distance between said first and second pins, and wherein said means for adjusting the distance between said pins includes a block member, said first pin being removably carried within an aperture provided in said member, and means for locking said first pin in said aperture.

6. An improved quilting machine according to claim 5, wherein said aperture is threaded, and said first pin is threadedly positioned in said aperture.

7. An improved quilting machine according to claim 6, including means coupled to said block for adjusting its displacement.

* * * * *